United States Patent [19]

Bishop

[11] 4,027,873

[45] June 7, 1977

[54] SHEET HANDLING APPARATUS

[75] Inventor: Thomas Desmond Bishop, Solihull, England

[73] Assignee: The Deritend Engineering Company Limited, Birmingham, England

[22] Filed: Apr. 29, 1976

[21] Appl. No.: 681,446

[30] Foreign Application Priority Data

Apr. 30, 1975 United Kingdom ..... 17940/75

[52] U.S. Cl. ..... 271/197; 271/180; 214/6 DS

[51] Int. Cl.[2] ..... B65H 29/32

[58] Field of Search ..... 271/174, 176, 177, 180, 271/182, 183, 189, 190, 194, 196, 197; 214/6 FS, 6 DS

[56] References Cited

UNITED STATES PATENTS

| | | | |
|---|---|---|---|
| 3,305,233 | 2/1967 | Cody | 271/197 X |
| 3,406,966 | 10/1968 | Walton | 271/197 X |
| 3,490,764 | 1/1970 | Müller et al. | 271/197 X |
| 3,682,469 | 8/1972 | Itoh et al. | 214/6 FS X |
| 3,820,779 | 6/1974 | Bishop | 271/197 X |

*Primary Examiner*—Robert W. Saifer
*Attorney, Agent, or Firm*—Marshall & Yeasting

[57] ABSTRACT

A sheet handling device, especially for stacking sheets, includes overhead conveyor belts with a suction chamber to hold sheets against their undersides and mechanism for displacing the sheets from the belts onto a table. This mechanism includes a set of fingers which, as well as being displaceable through the plane of the belts, are also displaceable in the direction of sheet feed to enable them to engage the sheets while travelling in the same direction at substantially the same speed and thereafter slow down the sheets and displace them towards the table.

10 Claims, 2 Drawing Figures

SHEET HANDLING APPARATUS

BACKGROUND OF THE INVENTION

This invention relates to apparatus for handling sheets of cardboard, card or the like particularly prior to or subsequently to processing of such sheets by for example a die-cutter machine.

According to one aspect of the present invention we provide sheet handling apparatus comprising a conveyor belt drive, suction means for drawing a sheet against a lower run of said belt drive to enable the sheet to be conveyed by the belt drive, at least one sheet-engaging element movable between an upper position at or above the plane of said lower run and a lower position below said plane, and drive means for effecting such movement of said at least one element, characterised in that said drive means is operable to impart to said at least one element a component of velocity in the direction of travel of said lower run, which velocity component is at least momentarily substantially the same as the belt speed when said at least one element is immediately below the plane of said lower run.

Although the invention is considered to be applicable to feeding of sheets from a stack to processing machinery, the primary application of the invention is in the stacking sheets as they are fed from processing machinery. Our prior British Pat. No. 1,340,004 shows one form of sheet stacking apparatus which solves many of the problems encountered with the stacking of continuously-fed fragile die-cut sheets. In particular, the integrity of the fragile sheets is maintained during transfer from the die-cutting station to the stacking station by synchronising the speed of the belts at the latter station with the sheet feed speed during transfer and then slowing the belts before ejecting the sheets onto the stacking table. However the time lost in slowing the belts and also in moving the ejector arms vertically upwardly and downwardly, imposes limits on the maximum length of sheet that can be fed in relation to the die cutter because the spacing between successive sheets must be sufficient to account for these losses in time.

SUMMARY OF THE INVENTION

According to one embodiment of the invention we provide sheet handling apparatus comprising a vertically adjustable table for supporting a stack of sheets, a conveyor belt drive having a lower run which extends over said table, suction means for drawing a sheet against said lower run to enable the sheet to be conveyed into overlying relation with said table, at least one sheet-engaging element movable between an upper position at or above the plane of said lower run and a lower position below said plane to eject a sheet out of engagement with said lower run for delivery onto the table, and drive means for effecting such movement of said at least one element, characterised in that said drive means is operable to impart to said at least one element a motion in which the element initially engages the sheet whilst travelling in substantially the same direction, and at substantially the same speed as, said lower run and thereafter decelerates to slow the sheet and moves downwardly to said lower position.

In the preferred embodiment of the invention upon arrival at said lower position, said at least one element is returned by said drive means to said upper position but at a location forward of its initial location and said at least one element is thereafter returned rearwardly by said drive means to its initial location preparatory to a fresh cycle of operation, said at least one element remaining in its upper position during such return movement to its initial location.

Thus, the sheet can be initially slowed down by said at least one element (conveniently there are at least two such elements arranged in two sets which are spaced apart in the direction of movement of said lower run and which operate in synchronism) and then lowered, away from the influence of said suction means, onto the stack supported by said table.

Preferably, said element(s) are returned to a position clear of the following sheet along a path which extends forwardly, i.e. in the direction of travel of said lower run, thereby allowing the leading edge of the sheet to be in closely spaced relation with the trailing edge of the first sheet.

DESCRIPTION OF THE PREFERRED EMBODIMENTS

Figure 1:
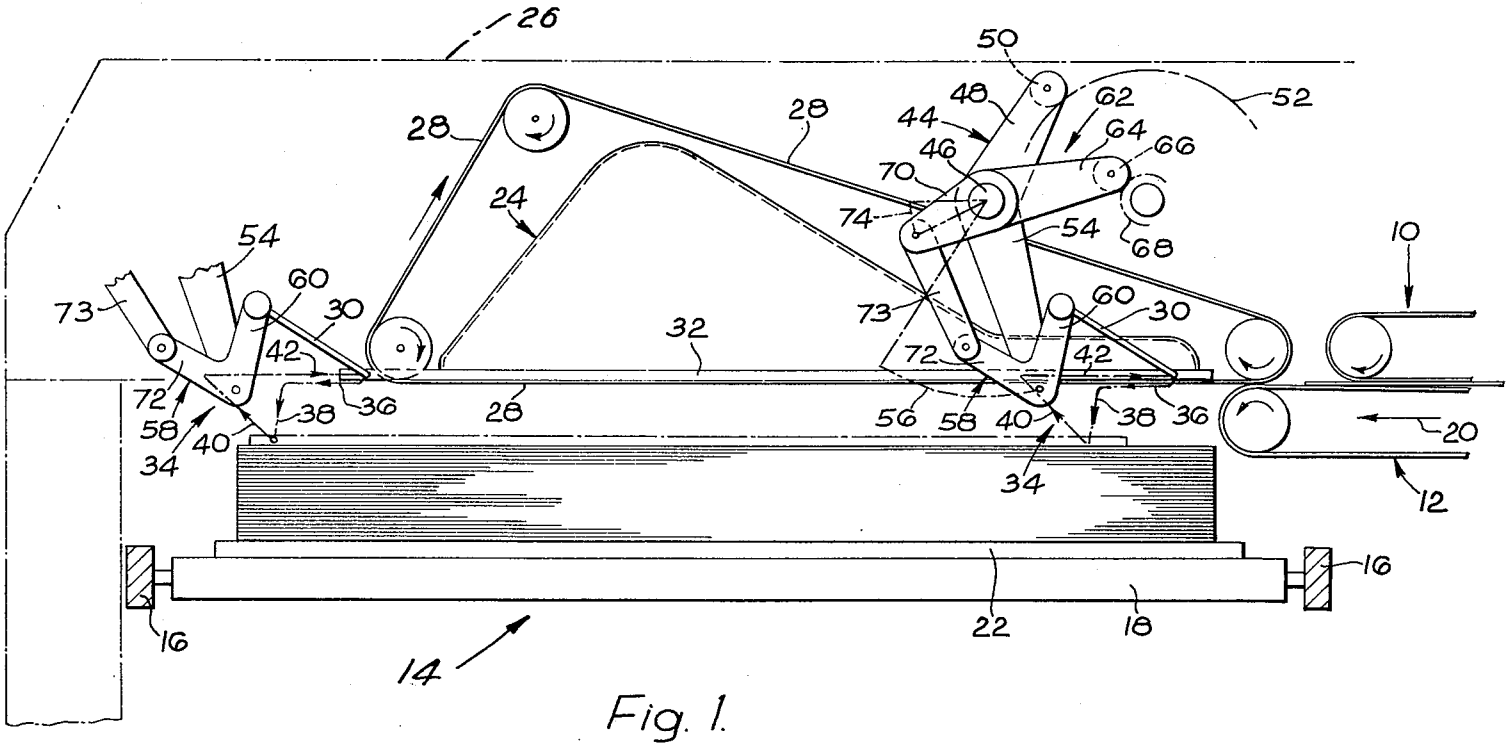
FIG. 1 is a schematic side view of a first embodiment of a stacker in accordance with the invention.

Referring firstly to FIG. 1, the sheet handling apparatus shown schematically is in the form of a stacker for receiving sheets of card, cardboard or the like in succession from sheet processing equipment such as a rotary die cutter machine and forming the sheets into a stack for ease of storage and subsequent handling. The die cutter or other machine may be of conventional form and for this reason only its output conveyor, comprising driven upper and lower endless conveyor belts 10, 12, is shown.

The stacker includes a conventional vertically-adjustable table 14 comprising a peripheral frame 16 mounting a series of freely rotatable parallel spaced rollers 18 arranged with their axes extending horizontally and parallel to the direction 20 of sheet feed. The rollers serve to support a stacking pallet or plate 22 at a position forwardly of the conveyors 10, 12 and below the plane of travel of the sheets. Suitable means (not shown), well known in the art, are provided for lowering the table as the stack grows so that the top of the stack can be maintained at a predetermined level below the plane of travel of the sheets.

A chamber 24 is located directly above the table within a housing 26 and is connected to an extractor fan or the like (not shown) so that the chamber 24 can be evacuated, the base of the chamber 24 being perforate to produce an upwardly-directed suction force immediately below in the space between the chamber 24 and the table. A conveyor belt drive 28 is associated with the suction chamber 24 and comprises a plurality of parallel, spaced-apart belts having co-planar, horizontal lower runs which extend beneath the base of the suction chamber 24 and lie in generally the same plane as the lower run of the conveyor 10. The belts 28 only underly part of the base of chamber 24 to enable the suction force to act via the inter-belt spaces. This arrangement allows the sheets to be conveyed from the conveyors 10, 12 and over the table by the belts 28 because the suction force maintains the sheets in engagement with the undersides of the belts 28. The belts 28 are driven at substantially the same speed as the belts 10, 12 to enable the sheets to be transferred smoothly. In contrast with our prior U.S. Pat. No. 1,340,004, the belts 28 can be driven at constant speed throughout operation of the stacker.

At transversely spaced positions with respect to the belts 28, for example at each side of the chamber 24, a sheet ejection device is provided for releasing sheets from the belts 28 to enable the sheets to collect one above the other in the stack supported by the table. Only one ejection device is shown in FIG. 1 but it will be understood that there will be at least one similar device in transversely spaced relation to the illustrated device. Each device comprises a pair of fingers 30 located one adjacent each end of the lower run of belts 28 and connected pivotally to an elongate link bar 32. The fingers 30 are mounted for movement under the control of respective compound cam and lever mechanisms, as hereinafter described, which operate cyclically in synchronism with one another and with feed of sheets from the conveyors 10, 12 so as to cause the lower ends of the fingers 30, and hence the link bar 32, to follow the path of movement indicated by reference numeral 34. At the beginning of each cycle, the link bar 32 is located in a retracted position in which its underside is immediately above the underside of the lower run of the conveyor 28. This position of the link bar is shown in solid outline. As the incoming sheet fed by conveyors 10, 12 passes beneath the suction chamber 24, the link bar 32 is lowered slightly with an acceleration in the direction of travel of the lower run of conveyor 28 so that when the link bar 32 engages the sheet, the link bar is moving in the same direction and at substantially the same speed as said lower run and hence the sheet. In this way, abrupt engagement of the link bar 32 with the sheet is avoided, which would otherwise damage the sheet, particularly as the sheet will be in a fragile condition following the die-cutting operation.

During the initial part of the cycle, the link bar 32 is constrained to travel a substantial distance, designated by reference numeral 36, in a direction parallel to said lower run and over this distance, the link bar is decelerated to smoothly slow down the sheet. Thereafter the link bar is rapidly lowered along the path section 38 to lower the sheet engaged thereby onto the stack. During such downward movement along path section 38, the influence of the suction force on the sheet diminishes, the vertical component of movement being selected so that the suction force will be ineffective to draw the sheet back towards the belts after it has been fully lowered by the link bars. Conveniently the suction force will be effective to keep the sheet in engagement with the link bars 32 as they descend. Alternatively the suction force may be of relatively short range in which case the link bars 32 may be lowered sufficiently rapidly to prevent disengagement of a sheet thereon or, in a modification, the link bars 32 may be hollow with perforate undersides and suction may be applied thereto as they are lowered towards the table.

As soon as the link bar reaches its lowest position (as indicated in outline), it is immediately drawn upwardly in the forwards direction along path section 40 until its underside is again above the underside of said lower run and therefore clear of engagement with the following sheet. This forward motion of the link bars during raising enables the following sheet to feed into the stacker in closer spaced relation to the first sheet than would be the case if the link bars were raised either purely vertically or back along the path sections 38, 36. After raising, the link bars 32 are returned rearwardly along path section 42 to their starting positions and a fresh cycle of operation is started when the leading edge of the following sheet approaches the leading ends of the link bars 32.

As mentioned, the cycle of movement of the link bars is effected by cam and lever mechanisms. Each mechanism comprises a first rocker 44 pivoted on a spindle 46 and having a first arm 48 which carries at its free end, a roller 50 which bears against a first rotary cam 52, part only of which is illustrated. The cam 52 causes the free end of a second arm 54 of the rocker 44 to oscillate to and fro about the axis of spindle 46 along the path 56. A V-shaped link 58 is pivoted at its apex to the free end of the arm 54 and the end of one limb of the link 60 carries the finger 30. A second rocker 62 is pivoted on the spindle 46 and has a first arm 64 carrying a roller 66 which bears against a second rotary cam 68 (part only of which is shown) and a second arm 70 which is connected by connecting link 73 to the other limb 72 of the V-link 58 so that the second arm 70 oscillates up and down along the path 74. By appropriate selection of the profiles of cams 52 and 68, the fingers 30, and hence the link bars 32, can be constrained to follow the paths as described above with the required changes in speed and direction.

Conveniently the link bars 32 will be either made of or have their undersides faced with a friction-enhancing material such as a suitable polyurethane to provide positive engagement with the sheets. To enable the invention to be applied to a stacker having two or more stacking stations, each provided with a table and located one in advance of the other in the direction of sheet feed, said cam and lever mechanisms may be adjustable to eliminate the downward movement of the link bars 32 so that an incoming sheet can pass through one stacking station and to the next and be stacked by operation of the link bars at the latter station. Thus, for example, means may be provided for disengaging the roller 66 from cam 68 or otherwise masking cam 68 so that the link 58 is not pivoted in a sense which causes downward movement of the associated link bar. In these circumstances, the link bars will simply oscillate to and fro without moving downwardly into engagement with a sheet.

Where two stacking stations are provided, each may be of the form illustrated in FIG. 1 or alternatively the chamber 24 and the lower run of belt drive 28 may extend over the tables of both stations, each station having at least one ejection device associated therewith. In use, stacking will be performed by first forming a stack at the station remote from the die-cutter and then forming a stack at the station prior thereto, thus enabling the first stack to be removed without interrupting feed of the sheets. Each station may be provided with a conventional side joggers and front and/or rear joggers to enable a properly aligned stack to be formed.

It will be understood that the path of movement for the link bars 32 may be varied depending upon conditions, i.e. the speed of the incoming sheets and that such variations may be effected relatively easily by using cams of different profiles. Another feature of the embodiment of FIG. 1, is that the arrangement can also be used for feeding sheets from a stack into for example a die cutter machine by reversing the operational cycle of the cam and lever mechanism. In this case, the top of the stack would be closer to the base of the chamber 24 and the path of movement of the link bars 32 would be reversed and modified so that the link bars are first lowered towards the stack and then raised again, the suction force being effective during such raising movement to draw the top sheet against the link bars. As they are raised, the link bars are accelerated in the direction of travel of the lower run of belts 28 (which direction will be opposite to that illustrated) so that when the sheet engages said lower run it will be travelling at substantially the same speed, and in the same direction as, the lower belt run. The sheet is then transferred from the link bars to the belt drive 28 and thereafter to the input conveyors 10, 12 (which will run in the opposite direction) of the die-cutter machine.

Figure 2:
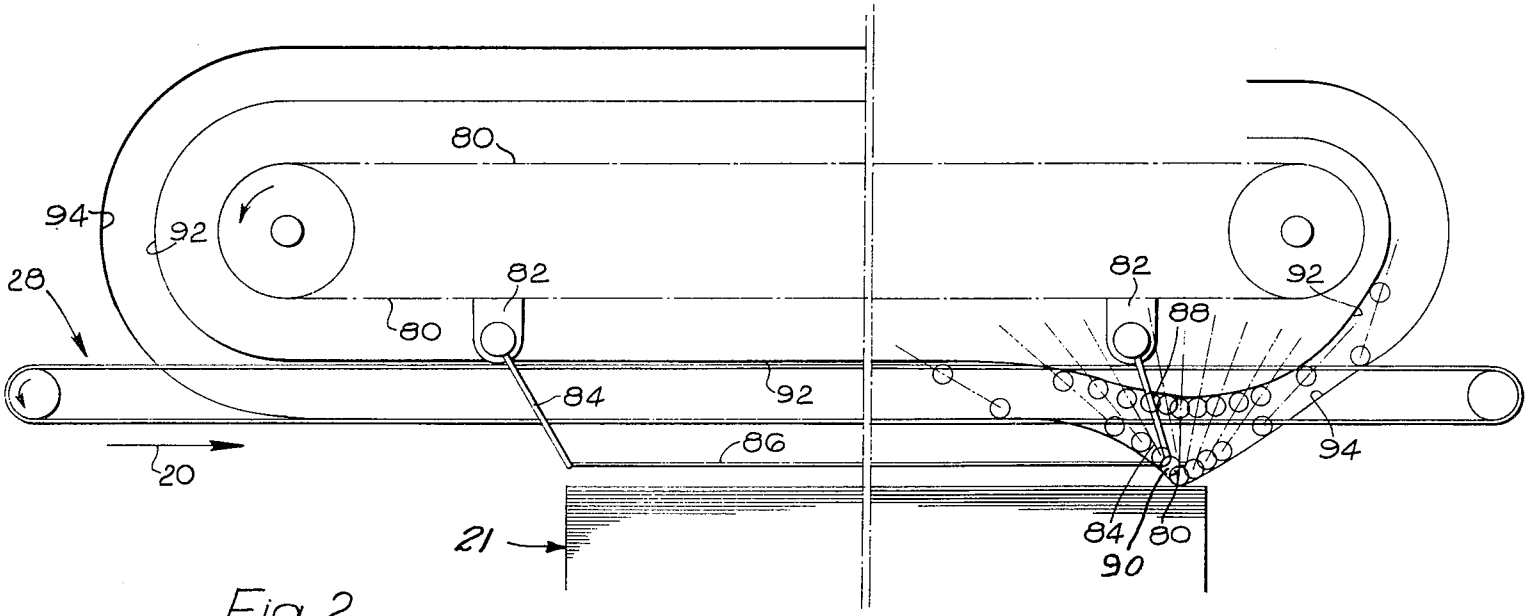
FIG. 2 is a schematic side view of a second embodiment.

FIG. 2 illustrates part of another form of stacker in which the cam and lever ejector mechanism is replaced by a chain driven mechanism. Only those parts of the stacker needed for understanding are illustrated in FIG. 2, i.e. the belt drive 28 whose lower run moves in the direction 20, and the stack 21. The ejector mechanism comprises a pair of driven, transversely spaced endless chains 80 (only one of which is shown) whose lower runs extend horizontally in the direction 20. Each chain 80 carries a pair of lengthwise spaced lugs 82 pivotally mounting fingers 84 which are coupled by push wires 86. The leading finger 84 carries a pair of rollers 88, 90 which co-operate with cam tracks 92, 94 respectively. The cam tracks 92, 94 are designed so that the leading finger is held with its free end above the lower run of the belt drive as it travels over the stack 21 until it is adjacent the end of the stack. In this region, the cam track 94 is cusp-shaped and the track 92 is downwardly arcuate so as to cause the leading finger 84 to change its orientation and undergo an up and down movement. This up and down movement of the leading finger 84 is transmitted to the trailing finger (which is not provided with roller cams) by the wire 86. In this way, the fingers 84 and wires 86 displace the sheets sucked against the belts 28 downwardly onto the stack 21. The chains 80 are driven at the same speed as the belts 28 and consequently when the fingers 84 first engage the sheet they will be travelling at substantially the same speed, and in the same direction, as the lower run of belts 28 but will thereafter decelerate in the direction 20 due to their increasing vertical component of movement thereby slowing down the sheet prior to depositing it on to the stack 21. In this embodiment, the cam tracks are specially shaped for ejection adjacent the front end of the belts 28. In a modification, the special shaping may be adjacent the rear end of the belts 28 and the trailing finger would then be provided with cam rollers and the leading finger would not be so provided, the leading finger being arranged to follow the ejection movement of the trailing finger by appropriate coupling elements. It will be understood that the positioning of the fingers 84 and the speed at which the claims 80 are driven will be synchronised with the sheet feed.

I claim:

1. Sheet handling apparatus comprising a conveyor belt drive, a suction chamber extending above a lower run of said belt drive, for drawing a sheet against said lower run to enable the sheet to be conveyed forward by the belt drive, at least one sheet-engaging element movable between a first position above the plane of said lower run and a second position below said plane, and drive means for effecting forward and downward movement of said element from said first to said second position, with a horizontal component of velocity which is momentarily substantially the same as the belt speed, and for effecting return movement of said element to said first position, characterized in that the path of said return movement extends from said second position forward and upward to bring said element above the plane of said lower run, and thence extends rearward above said plane to said first position.

2. Apparatus as claimed in claim 1 in which there is a plurality of said elements arranged in at least two sets which each comprise at least one element and are spaced apart in the direction of travel of said lower run.

3. Apparatus as claimed in claim 2 in which each set comprises two elements spaced transversely of the direction of travel of said lower run.

4. Apparatus as claimed in claim 2 in which movement of each element of each set is co-ordinated with movement of each element of the other set.

5. Apparatus as claimed in claim 2 in which each element of one set is coupled to a respective element of the other set by an elongate member, the movement of said coupled elements being coordinated such that the elongate member is maintained generally parallel to said lower run during upward and downward movement between said positions.

6. Apparatus as claimed in claim 5 in which the lower face of each elongate member is provided with a layer or coating of a friction-enhancing material.

7. Apparatus as claimed in claim 6 in which said material is a resilient plastics such as polyurethane.

8. Sheet handling apparatus as claimed in claim 1, comprising a vertically adjustable table below said lower run, in a position to receive sheets ejected from said belt drive by said element.

9. Sheet handling apparatus comprising a conveyor belt drive, suction means for drawing a sheet against a lower run of said belt drive to enable the sheet to be conveyed by the belt drive, at least one sheet-engaging element movable between an upper position which is at least as high as the plane of said lower run, and a lower position below said plane, and drive means for effecting such movement of said at least one element, characterized in that said drive means is operable to impart to said at least one element a component of velocity in the direction of travel of said lower run, which velocity component is at least momentarily substantially the same as the belt speed when said at least one element is immediately below the plane of said lower run, said drive means comprising for each said element a compound cam and lever mechanism, one part of which provides for horizontal movement of said element and a second part of which provides for vertical movement of said element.

10. Sheet handling apparatus comprising a conveyor belt drive, suction means for drawing a sheet against a lower run of said belt drive to enable the sheet to be conveyed by the belt drive, at least one sheet-engaging element movable between an upper position which is at least as high as the plane of said lower run, and a lower position below said plane, and drive means for effecting such movement of said at least one element, characterized in that said drive means is operable to impart to said at least one element a component of velocity in the direction of travel of said lower run, which velocity component is at least momentarily substantially the same as the belt speed when said at least one element is immediately below the plane of said lower run, said drive means comprising an endless chain drive having a lower run extending in the same direction as the lower run of said conveyor belt drive and in which said at least one element is carried pivotally by said chain and is provided with at least one cam follower arranged to cooperate with a cam track which constrains said element to follow a path of movement as aforesaid.

* * * * *